US010232921B2

(12) United States Patent
Ayotte et al.

(10) Patent No.: US 10,232,921 B2
(45) Date of Patent: Mar. 19, 2019

(54) MULTIFUNCTION THRUSTER ASSEMBLY FOR WATERCRAFT

(71) Applicant: Ocean Aero, Inc., San Diego, CA (US)

(72) Inventors: Thomas M. Ayotte, San Diego, CA (US); Scott M. Clifton, Surfers Paradise (AU); Chris G. Todter, San Diego, CA (US); Michael M. Todter, San Diego, CA (US)

( * ) Notice: Subject to any disclaimer, the term of this patent is extended or adjusted under 35 U.S.C. 154(b) by 0 days.

(21) Appl. No.: 14/999,798

(22) Filed: Jun. 27, 2016

(65) Prior Publication Data

US 2017/0137101 A1 May 18, 2017

Related U.S. Application Data

(60) Provisional application No. 62/231,163, filed on Jun. 25, 2015.

(51) Int. Cl.

| | |
|---|---|
| ***B63H 11/113*** | (2006.01) |
| ***B63H 11/02*** | (2006.01) |
| ***B63B 13/00*** | (2006.01) |
| ***B63B 13/02*** | (2006.01) |
| ***B63H 23/24*** | (2006.01) |
| ***B63G 8/08*** | (2006.01) |
| ***B63G 8/16*** | (2006.01) |
| ***B63G 8/22*** | (2006.01) |

(Continued)

(52) U.S. Cl.

CPC ..... *B63H 11/02* (2013.01); *B63B 13/00* (2013.01); *B63B 13/02* (2013.01); *B63B 39/03* (2013.01); *B63G 8/08* (2013.01); *B63G 8/16* (2013.01); *B63G 8/22* (2013.01); *B63H 5/14* (2013.01); *B63H 23/24* (2013.01); *B63H 25/46* (2013.01); *B63B 2035/007* (2013.01); *B63B 2207/02* (2013.01); *B63B 2751/00* (2013.01); *B63G 2008/004* (2013.01); *B63H 2005/075* (2013.01); *B63H 2025/425* (2013.01)

(58) Field of Classification Search

CPC ..... B63H 25/46; B63G 8/08; B63G 2008/08
USPC ..... 440/38, 40, 42
See application file for complete search history.

(56) References Cited

U.S. PATENT DOCUMENTS 1,001,594 A * 8/1911 Korganoff ..... D06F 75/12 223/51
3,517,633 A * 6/1970 Wanzer ..... B63H 25/42 114/151

(Continued)

FOREIGN PATENT DOCUMENTS

GB 1011594 8/1965

*Primary Examiner* — Daniel V Venne
(74) *Attorney, Agent, or Firm* — Todd N. Hathaway

(57) ABSTRACT

A thruster assembly that in addition to propulsion provides water flow to/from compartments and systems on board a vessel. In a first position, the thruster assembly provides propulsion/steering. Pivoted to a second position, operation of the thruster in a first direction draws a flow into the vessel and in a second direction draws a flow out of the vessel. The flows may be conveyed to/from compartments/systems on board the vessel via conduits in communication with a chamber having an opening through which the thruster drives the flows. The flows may be used to submerge/surface the vessel, or to provide systems cooling or serve other functions. Pivoted to a third position the thruster assembly is retracted and enclosed within the chamber to form a hydrodynamically clean exterior.

30 Claims, 11 Drawing Sheets

(51) Int. Cl.

| | |
|---|---|
| ***B63H 5/14*** | (2006.01) |
| ***B63B 39/03*** | (2006.01) |
| ***B63H 25/46*** | (2006.01) |
| *B63B 35/00* | (2006.01) |
| *B63G 8/00* | (2006.01) |
| *B63H 5/07* | (2006.01) |
| *B63H 25/42* | (2006.01) |

(56) References Cited

U.S. PATENT DOCUMENTS

| | | | | |
|---|---|---|---|---|
| 3,933,113 | A * | 1/1976 | Dornak, Jr. | B63H 11/02 114/151 |
| 4,208,978 | A | 6/1980 | Eller | |
| 4,214,544 | A | 7/1980 | Dashew et al. | |
| 5,642,684 | A | 7/1997 | Aker | |
| 5,758,592 | A | 6/1998 | Bensen | |
| 6,309,266 | B1 | 10/2001 | Forlano | |
| 6,363,874 | B1 * | 4/2002 | Griffith, Sr. | B63H 5/16 114/151 |
| 6,932,013 | B1 | 8/2005 | Shen | |
| 7,201,621 | B2 | 4/2007 | Jones | |
| 7,862,393 | B2 | 1/2011 | Levander et al. | |
| 8,082,870 | B2 | 12/2011 | Shen | |
| 8,490,569 | B2 | 7/2013 | Shen | |
| 9,376,186 | B2 * | 6/2016 | Brizzolara | B63H 5/14 |

* cited by examiner

MULTIFUNCTION THRUSTER ASSEMBLY FOR WATERCRAFT

RELATED CASES

This application claims the benefit of Provisional Patent Application Ser. No. 62/231,163 filed Jun. 25, 2015.

BACKGROUND a. Field of the Invention

The present invention relates generally to thrusters that provide motive power for watercraft, and, more particularly, to a thruster assembly that performs both propulsion and ballasting/dewatering functions onboard a vessel.

b. Related Art

Thrusters, as relate to waterborne vessels, are propulsive devices that are generally employed to propel and/or maneuver the vessel. As compared with shaft drives and other forms of propulsion that employ a remote power plant, thruster units commonly include an electric or hydraulic motor mounted in close association with the propeller itself in a submerged location, with electrical power or hydraulic pressure being supplied to the motor from a remote location within the hull. The propeller is frequently enclosed within a circular shroud. The motor may be reversible, and in some instances the assembly is pivotable so as to change the direction of thrust, e.g., to provide a steering effect.

Thruster units provide significant advantages in many applications, but like all propulsion systems they consume a degree of power. Power consumption is virtually always a concern in vessel design and operation, but it even more so in the case of watercraft and other vessels that are small in size and/or are intended to operate for long periods of time without refueling. Exemplary of this type of vessel are craft intended for autonomous operation such as for observation and surveillance purposes, for example. Such craft—referred to from time-to-time as unmanned autonomous vessels (UAVs)—frequently rely on wind, waves and/or sunlight as sources of energy to satisfy their power requirements in whole or in part. Typically, power requirements include not only propulsion, but steering and guidance systems, sensors onboard computing systems, and other electrical or mechanical loads as well. Moreover, some such vessels are designed for submersible operation, which necessitates pumping equipment to ballast and deballast in order to submerge and surface the craft. The low energy density of environmental sources (wind, solar, wave) means that comparatively small amounts of power can be obtained, with the result that the power budget is generally very tight. A related factor is that any added weight requires more power to propel, thus increasing energy consumption.

Much weight is the result of multiple components required to perform the above and additional functions. Furthermore, complexity and multiple components tend to both increase cost and reduce reliability, the latter again being a particularly significant consideration in the context of UAVs that must operate for extended periods with little or no human intervention. Weight and complexity also negatively impact the ability to transport, launch/retrieve and handle the craft. For example, many UAVs must be transported to distant operating areas (e.g., for military operations, ocean surveying, meteorological observations, and so on), often onboard an aircraft where weight and space are at a premium. Furthermore, after arriving at the operating area the craft must frequently be handled and launched from/recovered to a ship or other mother vessel, where excess weight can be a significant detriment. Still further, excess weight can compromise the vessel's maneuverability and responsiveness during operation.

Accordingly, there exists a need for an apparatus that enables a waterborn vessel to employ a thruster for propulsion while taking advantage of the thruster for other functions, so as to consolidate systems and reduce overall complexity and weight of the vessel. Furthermore, there exists a need for such an apparatus that can be economically constructed and that is robust and able to perform reliably without excessive maintenance.

SUMMARY OF THE INVENTION

The present invention addresses the problems cited above, and provides a thruster assembly having multiple functions, including the functions of providing propulsion for a vessel and of supplying and withdrawing flows of water to an interior volume, system or other location onboard the vessel.

In a broad aspect, the invention provides an assembly comprising: (a) a thruster that generates a flow of water generally along an axis of the thruster; (b) a passage into the vessel, the passage having an opening generally at an exterior of the vessel; and (c) a mechanism that pivots the thruster between a first position in which the axis of the thruster is directed to produce a flow that provides propulsion to the vessel, and a second position in which the axis of the thruster is directed into the end opening of the passage to produce a flow that enters or exits the vessel.

The passage into the vessel may comprise a chamber having the opening of the passage formed therein. The passage may further comprise at least one conduit extending from the chamber to an interior of the vessel. The at least one conduit may comprise an input conduit through which water flows from the chamber to on board the vessel in response to operation of the thruster in a first direction. The at least one conduit may comprise an outlet conduit through which water is withdrawn from the vessel in response to operation of the thruster in an opposite direction. The at least one conduit may comprise a first, inlet conduit in fluid communication with the chamber, and a second, outlet conduit in a fluid communication with the chamber. The conduits may comprise check valves that prevent backflow of water therethrough.

The opening of the conduit may be located generally at a side of the vessel, with the chamber extending into an interior of the vessel. The side of the vessel at which the opening is located may be a bottom side of the vessel. The mechanism that pivots the thruster may comprise a mechanism that pivots the thruster from a first position in which the axis of the thruster extends generally parallel to an axis of the vessel, to a second position in which the axis of the thruster extends generally perpendicular to the axis of the vessel so as to be directed into the opening of the chamber. The pivot mechanism may be operable to pivot the thruster to a third position in which the thruster is received in an interior of the chamber in a position inverted from the propulsion position.

The mechanism that pivots the thruster may comprise at least one pivot connection located proximate the external opening, about which the thruster is pivoted between its positions. The thruster may comprise a plate that is mounted to the thruster that closes off the exterior opening in response to the thruster being pivoted to the propulsion position, and that pivots upwardly together with an end of the thruster in response to the thruster being pivoted to the secondary position so as to permit the end of the thruster to enter the exterior opening. The closure plate may comprise an outer edge that conforms closely to an edge of the exterior opening when the thruster is in the drive position.

The mechanism that pivots the thruster between the primary and secondary positions, i.e., drive mechanism, may comprise a pinion gear that is mounted to the thruster, a drive gear that is in engagement with the pinion gear, and a mechanism that rotates the drive gear—i.e., actuator mechanism—so that in response the pinion gear rotates in an opposite direction so as to pivot the thruster. The drive gear may comprise a quadrant gear. The actuator mechanism that rotates the drive gear may comprise a linear actuator, and a linkage connecting an end of the linear actuator to the drive gear at a location spaced from an axis of the drive gear. The linear actuator may comprise a hydraulic cylinder, and the linkage may comprise a link rod having a first end mounted to the end of the hydraulic cylinder and a second end mounted to the drive gear. The hydraulic cylinder may comprise a second end that is mounted to the chamber via a swing arm that enables the linear actuator to pivot as the actuator is extended and retracted. The swing arm may comprise a first end that is pivotably mounted to the second end of the hydraulic cylinder, and a second end that is pivotably mounted to the chamber. The second end of the swing arm may be pivotably mounted to the pivot of the drive gear.

The assembly may further comprise a base that supports the pivot mechanism, chamber and thruster, and that is mountable in a cooperating opening in the vessel.

The conduits may comprise conduits leading into and out of a hull space of the vessel or a compartment of the vessel. The flows of water through the conduits may serve the functions of flooding and dewatering to submerge and surface the vessel or to ballast the vessel, or may serve other functions.

These and other features and advantages of the present invention will be more fully appreciated from a reading of the following detailed description with reference to the accompanying drawings.

DETAILED DESCRIPTION

Figure 1:
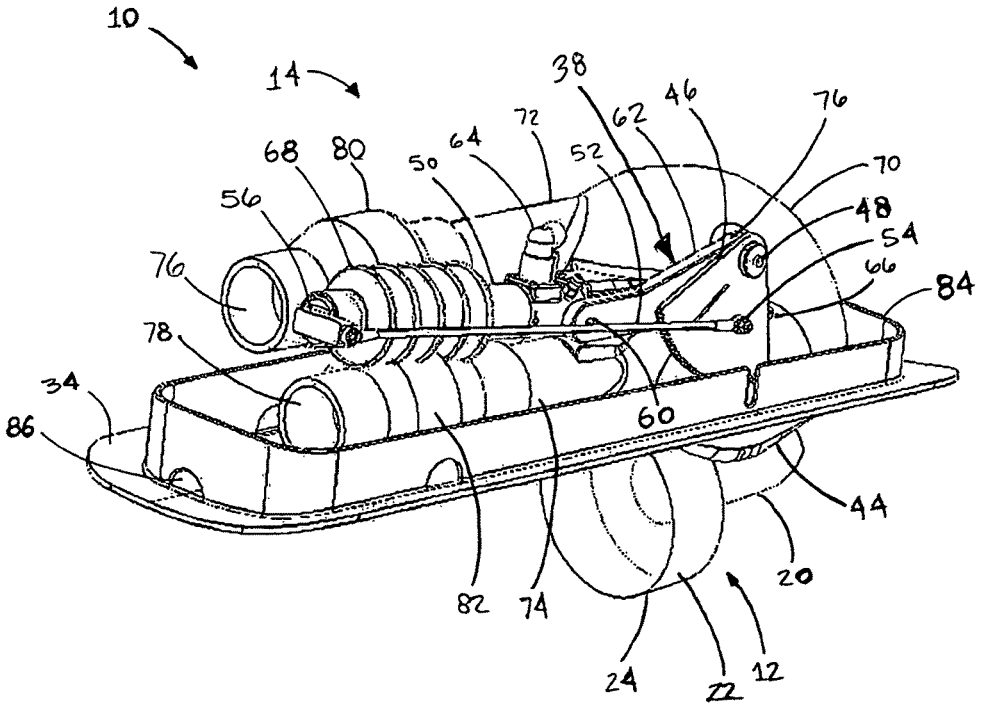
FIG. 1 is a perspective view, partially in phantom, of a multifunction thruster assembly in accordance with the present invention.

FIG. 1 shows a multifunction thruster assembly 10 in accordance with the present invention. Principal subassemblies of the system include a thruster assembly 12 and a flow directing assembly 14. As will be described in greater detail below, the thruster assembly includes a motor-driven thruster that generates a flow of water, while the flow directing system in turn positions the thruster and directs the flow to perform multiple tasks, namely, propulsion and ballasting of the vessel in the illustrated embodiment. It will be understood that, depending on application, additional secondary functions may be performed in addition to ballasting of the vessel, such as systems cooling or washdown functions, for example.

Figure 2:
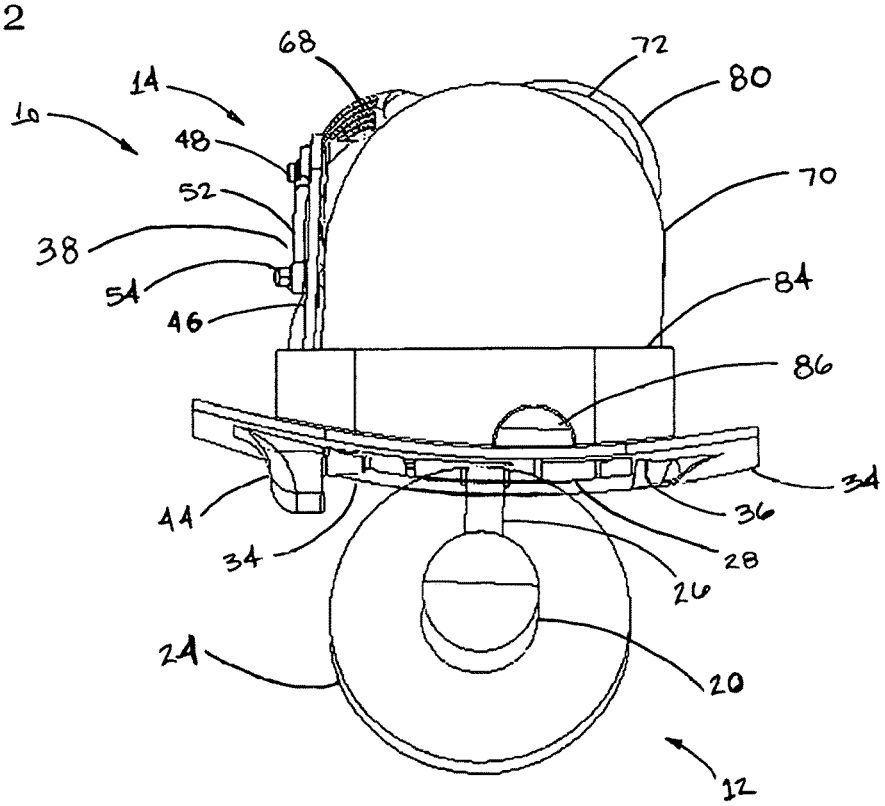
FIG. 2 is a front elevational view of the multifunction thruster assembly of FIG. 1.
Figure 3:
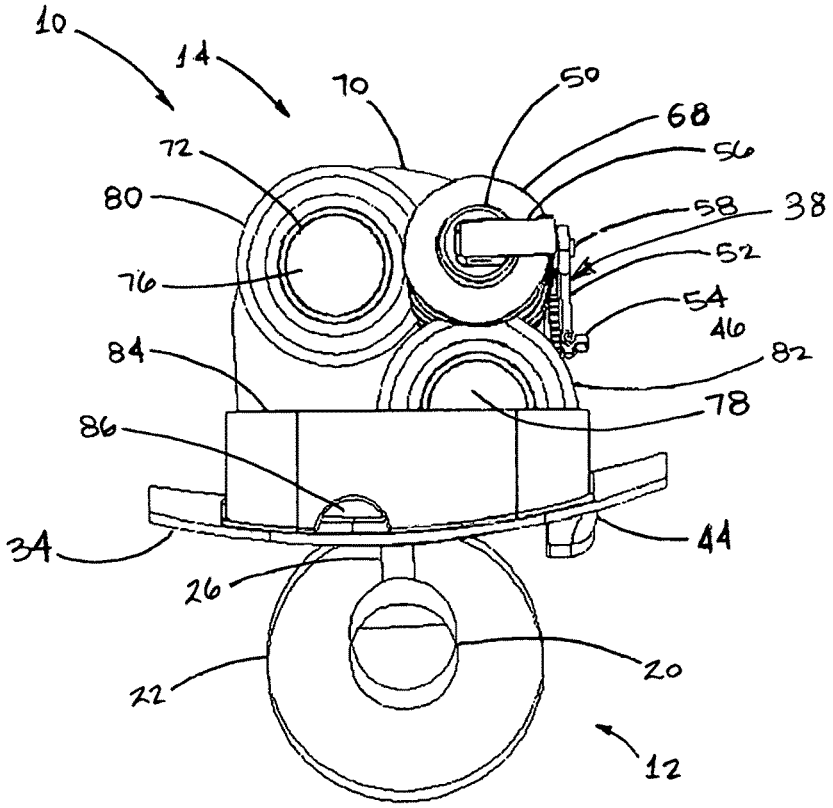
FIG. 3 is a rear elevational view of the multifunction thruster assembly of FIG. 1.

Referring again to FIG. 1 and also FIGS. 2-3, it can be seen that the thruster assembly 12 includes a motor section 20 having a drive motor, which may be an electric motor driven by batteries in the associated vessel, or which may be of a hydraulic, mechanical or other type in some instances. The motor section drives a propeller section 22 having a propeller (not shown) housed within a shroud 24, the latter serving to contain and direct the water flow that is produced by operation of the propeller. As can better be seen in FIGS. 2-3, the forward end of the thruster is supported by a short tubular shaft 26 from a somewhat door-shaped pivotable panel 28, the tubular shaft also housing wiring by which power and control inputs are supplied to the motor. The upper edge of the propeller shroud 22 is in turn mounted to panel 28 to support the rearward end of the assembly, so that the motor and propeller sections of the thruster are rigidly joined to and supported by the pivotable panel. An example thruster suitable for use in the assembly is the SeaBotix™ BTD150, available from SeaBotix Inc., 1425 Russ Blvd, San Diego, Calif., 92101.

Figure 5A:
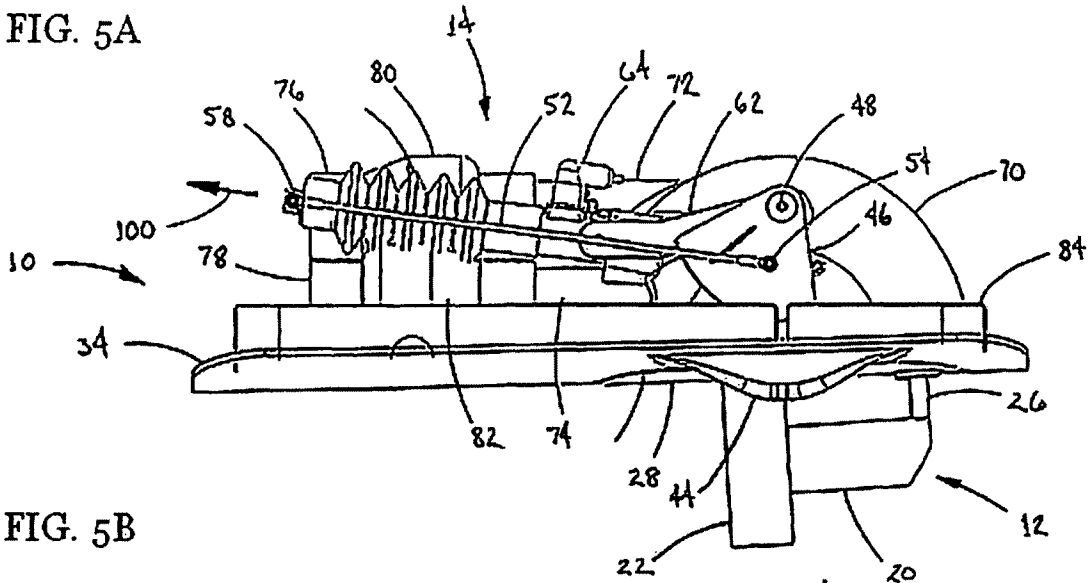
FIGS. 5A-5B are side elevational and bottom plan views of the multifunction thruster assembly of FIGS. 1-3, in the deployed position shown in FIG. 4.
Figure 5B:
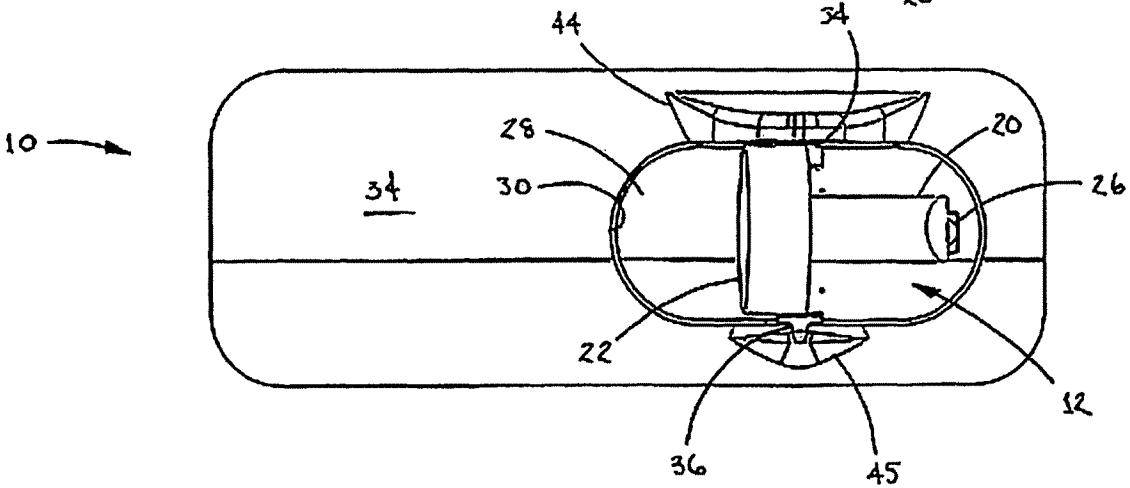
Figure 6:
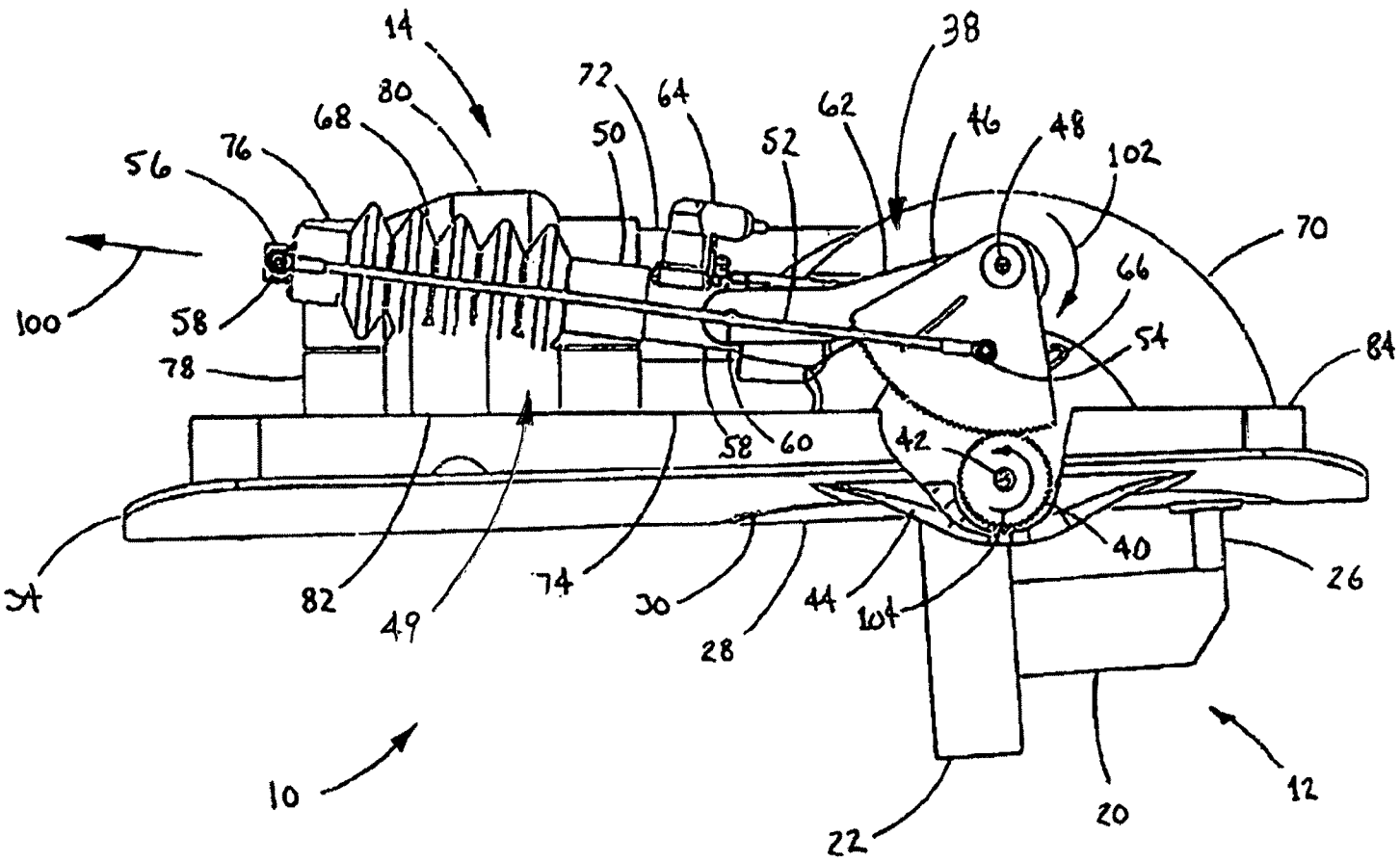
FIG. 6 is an enlarged elevational view of the multifunction thruster assembly of FIGS. 1-3 in the deployed position shown in FIG. 5A, partially cutaway to show the drive mechanism that pivots the thruster between operating and stowed positions.

As can be seen with further reference to FIGS. 2-3 and also FIGS. 5A-5B and 6, panel 28 is received with a generally correspondingly shaped edge 30 of an opening 32 (see FIG. 8A) formed in a belly plate 34 that is mounted to the hull of the vessel, the belly plate preferably being contoured to form a faired surface with the surrounding area of the hull. Panel 28 is supported within opening 32 on horizontal axis pivots 34, 36, that lie more-or-less within the general plane of the belly plate. As can also be seen in FIG. 5B, the transverse axis of the pivots 34, 36 is located generally proximate a lengthwise midpoint of the panel 28, so that when pivoted in a first direction a front end of the panel swings upwardly above the level of the belly plate and the rearward end pivots downwardly below the belly plate, and vice versa, together with the components of the thruster unit that are mounted on the panel.

FIG. 6 illustrates the drive mechanism 38 that pivots the thruster assembly between its operating positions. As can be seen, a first gear 40 is mounted to the outer end of the shaft 42 of pivot connection 34, so that in response to rotation of the gear the panel and associated thruster unit tilt in one direction or the other in the manner described above. The downwardly protruding portion of gear 40 is housed within a depending blister 44 on the belly plate. The upper portion of gear 40 is in turn engaged by a second, larger gear, in the form of a quadrant gear 46. The quadrant gear is supported on a horizontal stub axle 48 and engages the smaller gear 40 in the manner of a pinion gear, so that rotation of the quadrant gear 46 in a first direction rotates the smaller gear 40 at a greater rate and in the opposite direction.

Rotation of the gears 36, 40, thus pivoting plate 28 and the thruster 12, is accomplished by operation of an actuator mechanism 49. In the illustrated embodiment, the actuator mechanism comprises a linear actuator, in the form of a hydraulic cylinder 50, and a link rod 52 that is connected to the quadrant gear 46. As can be seen in FIGS. 1 and 6, a forward end of the link rod is mounted to the quadrant gear at a first horizontal axis pivot connection 54, while the other end of the rod is mounted to the rearward end of the hydraulic cylinder by second horizontal pivot connection 58. The forward end 58 of the hydraulic cylinder is in turn mounted to a pivot connection 60 on the rearward end of a swing arm 62, the forward end of the latter being pivotally connected to the stub axle 48 inboard of quadrant gear 46. Therefore, extension of the hydraulic cylinder, in response to pressure supplied by hydraulic connection 64, draws the link rod 52 rearwardly, pivoting the quadrant gear in a clockwise direction as seen in FIG. 6, thus rotating gear 40 so as to pivot the door plate and thruster unit in the opposite (counterclockwise) direction; retraction of the cylinder in turn forces the link rod in a forward direction and reverses operation of the gear train and pivoting motion of the thruster assembly. The pivot joints 54, 58, 60 and 48 allow the angular geometry of the assembly to adjust as the linear actuator extends and retracts, the pivot connection 54 on the quadrant gear having an inboard end that rides in an arcuate guide slot 66 so as to constrain the movement to the desire range of motion. A resilient bellows-type gaiter 68 installed about the shaft of the hydraulic cylinder 50 protects the shaft and cylinder from exposure to salt water during immersion. It will also be understood that some embodiments may employ other forms of linear actuators, such as pneumatic cylinders, gear racks, ball screws and linear motors, for example.

As noted above, the plate 28 from which the thruster is suspended is located within opening 32 that leads upwardly into the assembly. As can be seen with further reference to FIG. 8A and also FIGS. 1-3, the opening 32 is formed in the bottom of a domed chamber 70, that extends upwardly above the belly plate 34 into the interior of the vessel. Discharge and intake lines 72, 74 communicate with chamber 70 and extend rearwardly therefrom, the intake line being set somewhat lower than the discharge line so as to be positioned more closely adjacent the bottom of the hull. In addition, a boss 76 on one side of the chamber wall supports the horizontal stub axle 48 of the pivot assembly, with guide channel 66 being formed in the side of the chamber somewhat below the stub axle.

The discharge and intake lines 72, 74 include end openings 76, 78 that communicate with an interior volume or compartment of the vessel. The openings may be located directly within the compartment or volume into which water is discharged and from which it is drawn, or hoses, manifolds or other conduits may be connected to the openings so as to lead the flow to/from remote locations. Check valves 80, 82 are installed in lines 72, 74 so as to prevent backflow. Consequently, water may be supplied to an interior volume of the vessel from chamber 70 through line 72, and withdrawn back out via line 74. In the illustrated embodiment, the intake pipe and lower portion of the chamber are set within a tray-shaped coaming 84 extending upwardly from belly panel 34 that fits within a cooperating hull opening so as to locate the assembly in the bottom of the vessel and that also imparts strength and structural rigidity to the assembly, with drain parts 86 being formed in the coaming above the belly plate to permit water to pass therethrough during deballasting.

Mounted together on the belly plate, the assembly forms a compact, structurally self-contained unit that can be mounted in a corresponding opening in the hull of the vessel and that can be conveniently removed for servicing. In some embodiments, however, some the components may be mounted to the hull or other structure of the vessel while others may be mounted to the assembly base, or all of the components may be mounted to or built into the structure o the vessel itself.

Operation of the multifunction thruster assembly is illustrated in FIGS. 4-11, with respect to an exemplary submersible craft 90 that is shown in simplified form, having a hull 92 with an interior volume or compartment 94.

Figure 4:
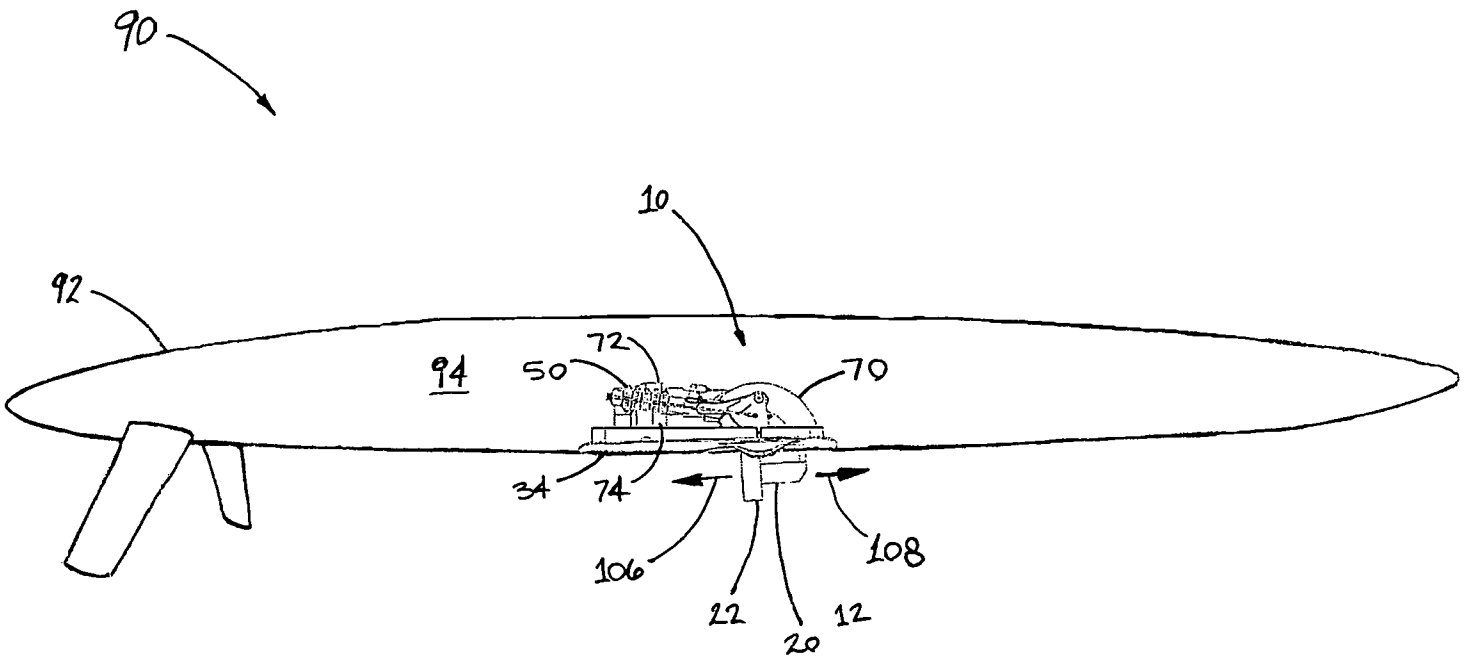
FIG. 4 is a side elevational view of a submersible vessel having the multifunction thruster assembly of FIGS. 1-3 mounted therein, showing the thruster assembly deployed below the hull of the vessel to operate in a propulsion mode.

Firstly, FIGS. 4-6 show the thruster assembly positioned to function in a propulsion mode, providing thrust to move/maneuver the vessel. To bring the assembly to the propulsion configuration, the controls are actuated to extend hydraulic cylinder 50, in the direction indicated by arrow 100 in FIGS. 5A and 6. As noted above, this in turn draws link rod 52 rearwardly, causing the quadrant gear 46 to rotate about axle 48 in the direction indicated by arrow 102 in FIG. 6. In so doing, the quadrant gear rotates the pinion gear 40 in the opposite direction, as indicated by arrow 104, bringing the motor and propeller 20, 22 of the thruster unit 12 to a horizontal axis orientation. Simultaneously, panel 28 comes to a horizontal orientation, closing off the opening 32 at the bottom of chamber 70 and fitting closely within the edge 30 of the opening to form a smooth, substantially continuous contour. Thus positioned, forward and reverse operation of the thruster unit 12 generates forward and reverse propulsive thrust, in the direction indicated by arrows 106, 108 in FIG. 4. It will be understood that some embodiments may employ different forms of mechanisms to pivot the thruster assembly between positions, such as crank, chain-and-sprocket, pulley and motor mechanisms, for example.

Figure 7:
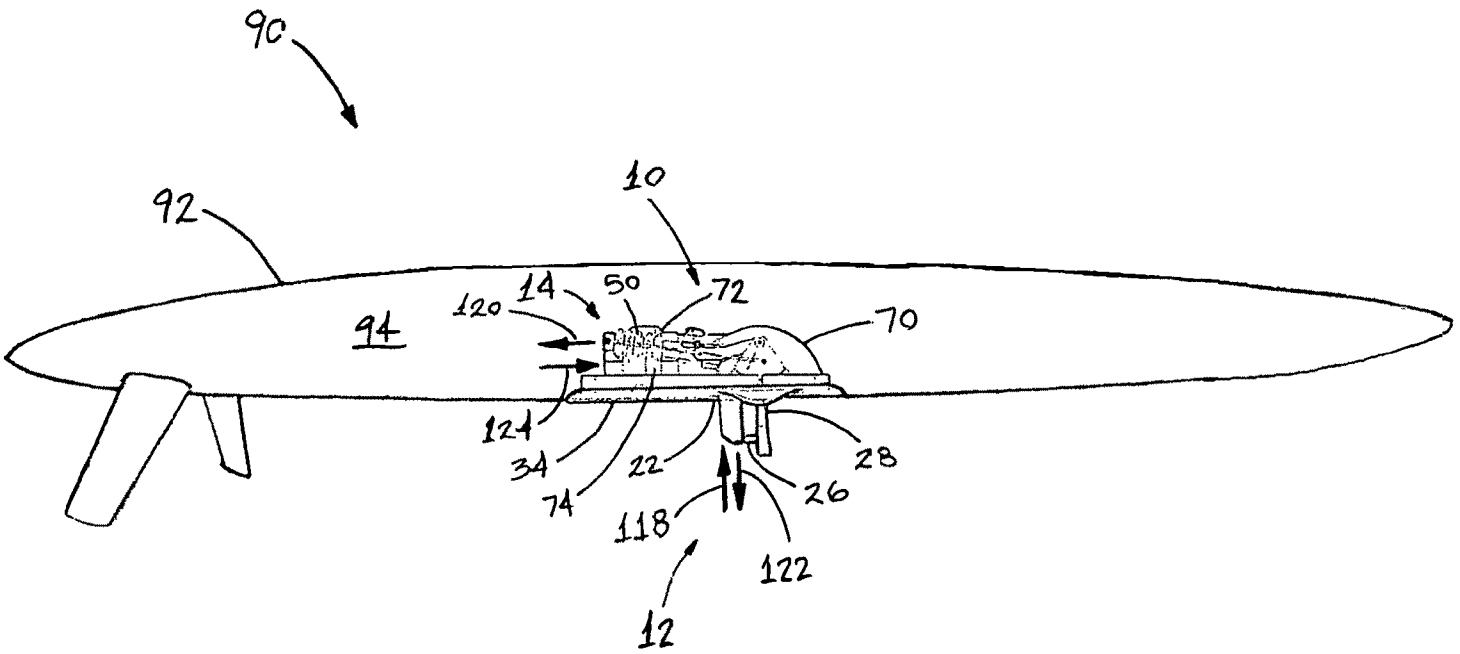
FIG. 7 is a side elevational view of the vessel and thruster assembly of FIG. 4, showing the thruster assembly pivoted to a second operational position for flooding/dewatering an interior compartment of the hull to submerge or surface the vessel.
Figure 8A:
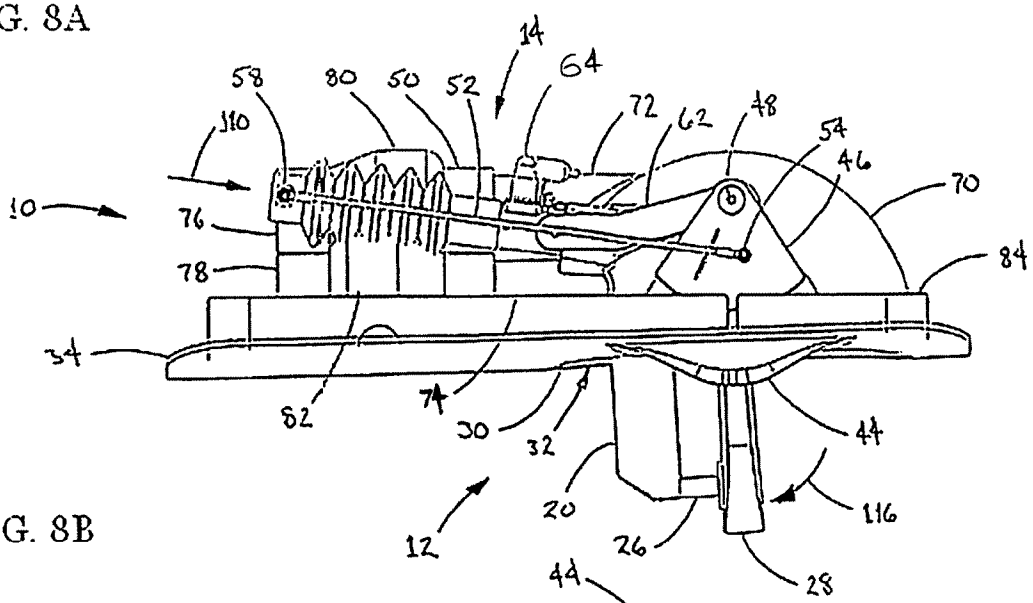
FIGS. 8A-8B are side elevational and bottom plan views of the thruster assembly of FIGS. 1-3 in the second deployed position of FIG. 7.
Figure 8B:
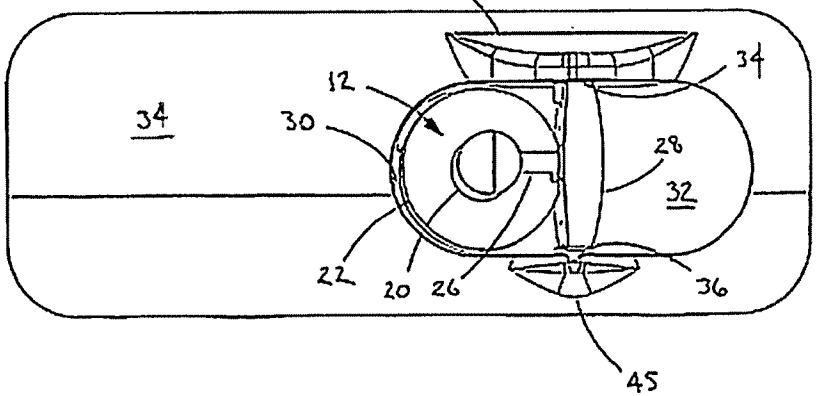
Figure 9:
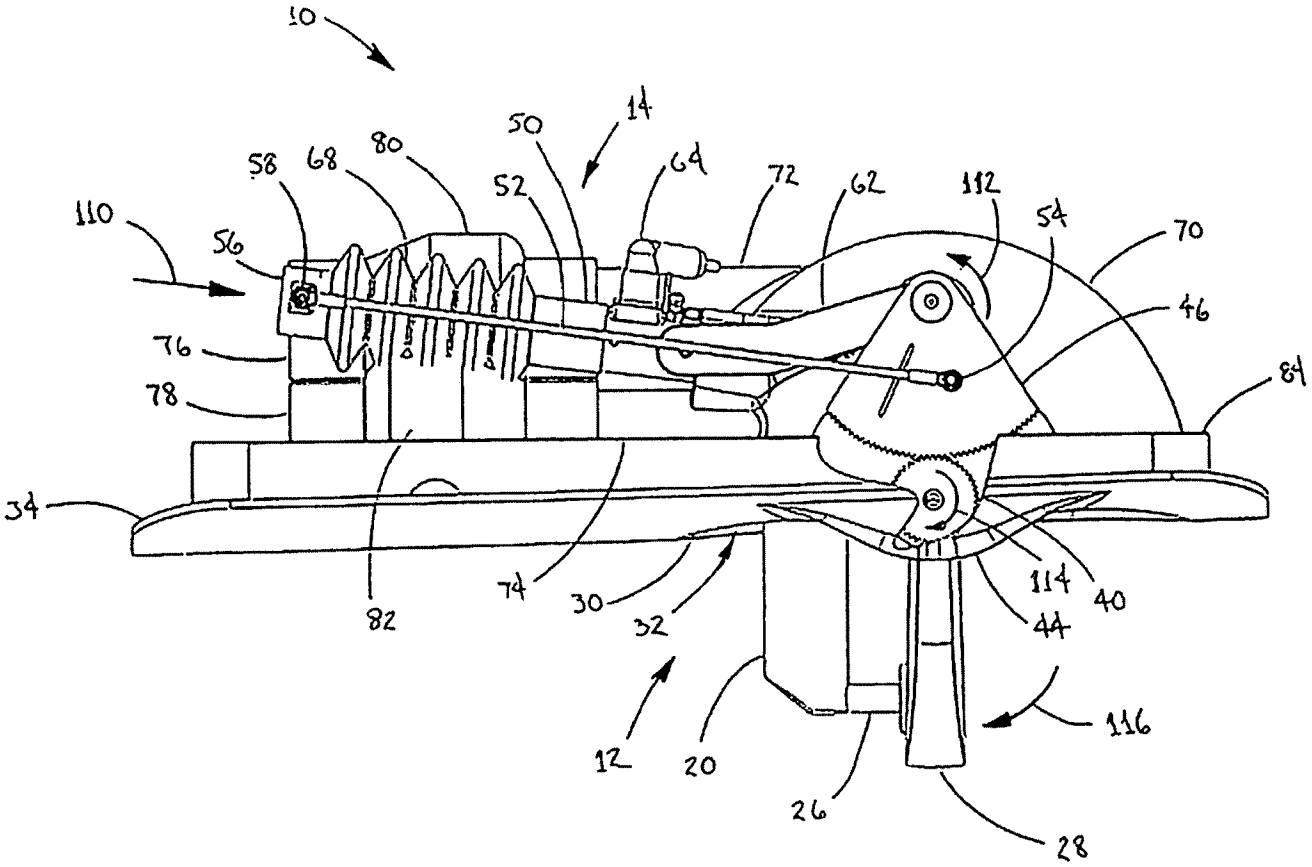
FIG. 9 is an elevational view of the thruster assembly of FIGS. 1-3 in the position of FIG. 8A, partially cutaway to show the position of the drive mechanism of the assembly in greater detail.

FIGS. 7-9, in turn, show the vessel 90 with the thruster assembly configured to operate in a ballasting/dewatering mode.

In order to shift the thruster assembly to the ballasting position, hydraulic cylinder 50 is retracted in the direction indicated by arrow 110 in FIGS. 8A-9, driving link rod 52 forward towards chamber 70 so as to rotate quadrant gear 46 in a counterclockwise direction (viewed from the right side), as indicated by arrow 112 in FIG. 9. This in turn rotates pinion gear 40 in a clockwise direction together with closure panel 28, in the direction indicated by arrows 114 and 116. As the front of the closure plate tilts downwardly, the rearward end tilts upwardly into chamber 70, until the thruster unit 12 is aligned vertically, with the shrouded propeller section 22 of the thruster being received in the rearward portion of the chamber opening 32 aft of the closure plate pivot connections 34, 36, as seen in the bottom view of FIG. 8B. In this position, operation of the thruster in its forward direction draws water upwardly from the bottom of the craft and force it into chamber 70, as indicated by arrow 118 in FIG. 7, from which the water is then discharged into the interior volume of the vessel in a direction indicated by arrow 120. Dewatering is accomplished by operating the thruster in the reverse direction, as indicated by arrow 122 in FIG. 7, drawing the water from the interior volume into intake line 74 in the direction indicated by arrow 124. The flooding and dewatering of the interior volume, which as noted above may be a dedicated compartment or simply an interior of the hull, may be performed in order to ballast/submerge the vessel and the deballast/surface the vessel, for example, or for other purposes. Moreover, as was also noted above, the flow of the water to/from the chamber may be utilized for other purposes, such as equipment cooling or topside washdown/decontamination, for example. Still further, it will be understood that only inflow or outflow functions and not both may be present in some embodiments, and similarly that only a single input/output conduit may be included, rather than multiple conduits as shown.

Figure 10:
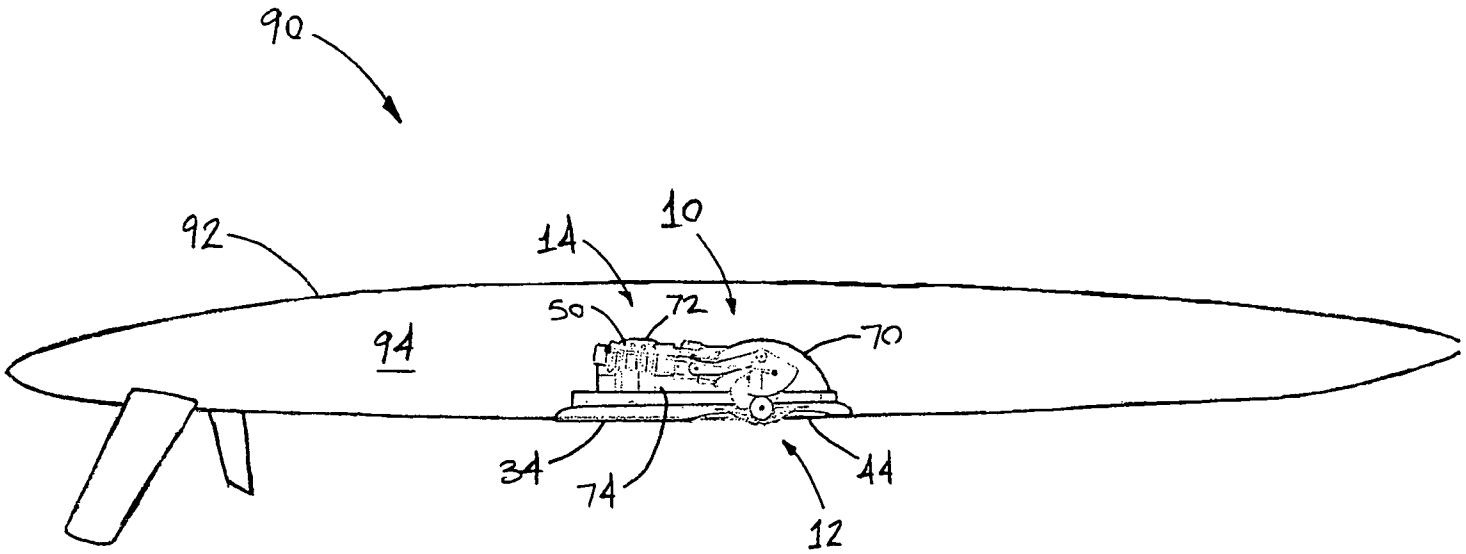
FIG. 10 is a side elevational view of the autonomous vessel and thruster assembly of FIG. 4, showing the thruster assembly pivoted to a stowed position in which the thruster assembly is passive, such as when operating on wind propulsion or during transportation/storage of the vessel, for example.
Figure 11:
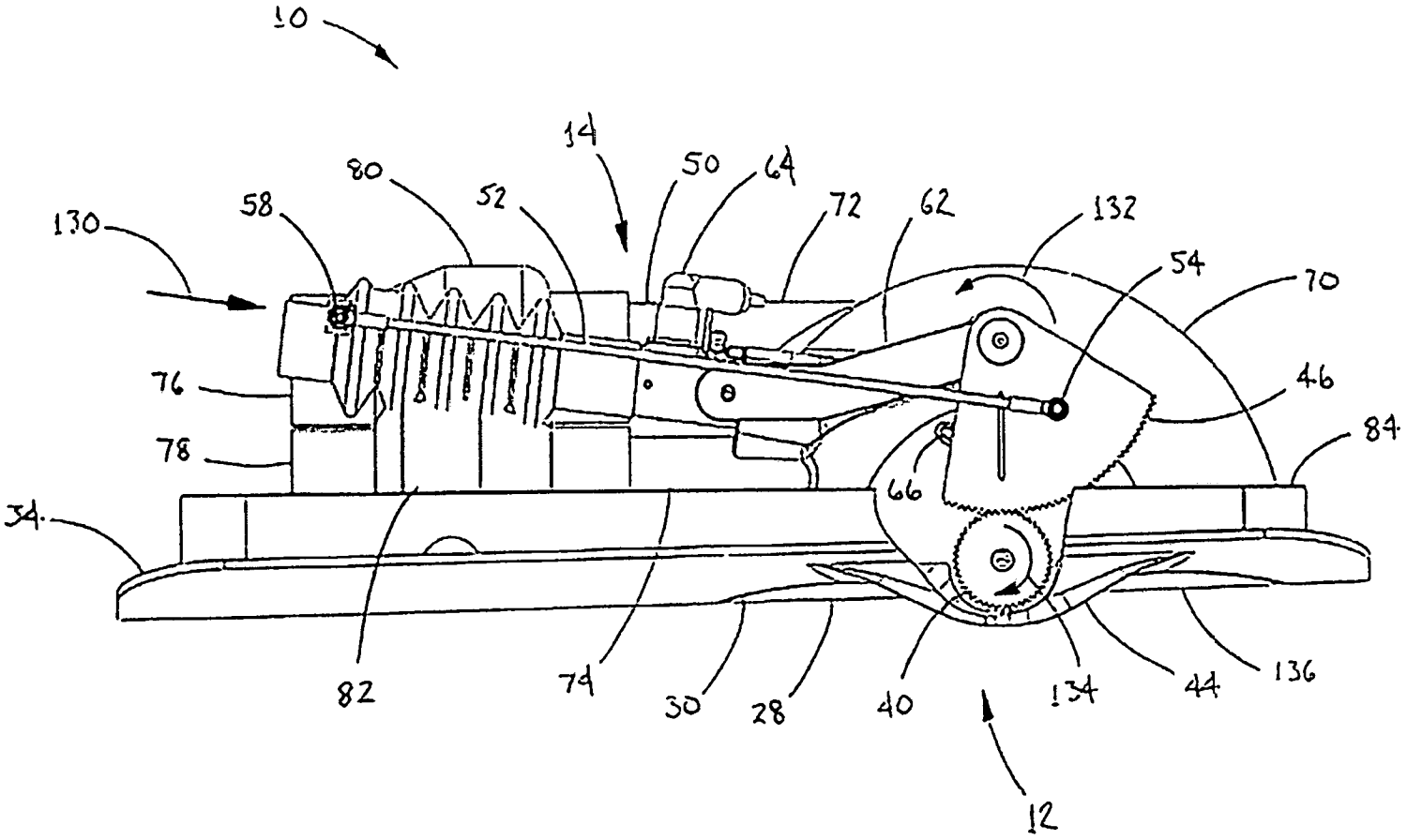
FIG. 11 is an enlarged side elevational view of the multifunction thruster assembly of FIGS. 1-3, in the position of FIG. 10, partially cutaway to show the position of the drive mechanism when the assembly is in the stowed configuration.

FIGS. 10-11 show the thruster assembly in a stowed configuration, for operation of the craft by wind power using sails (not shown) or for transportation/storage of the vessel, for example. To shift the thruster assembly to the stowed position, the hydraulic cylinder 50 is further retracted, in the direction indicated by arrow 130 in FIG. 11, driving link rod 52 further forward and rotating quadrant gear 46 in the direction indicated by arrow 132. Pinion gear 40 counter rotates in the direction indicated by arrow 134, further from the position shown in FIG. 9, pivoting the closure panel 28 until it is inverted from the original propulsion position shown in FIGS. 4-6 and the motor and propeller sections of the thruster unit are received and enclosed within the interior of chamber 70. The exposed surface 136 of the now inverted closure panel is contoured to correspond to the adjoining surface of belly plate 34 and fits closely within the edge 30 of the chamber opening, thus forming a smooth, substantially continuous low-drag surface with minimal protrusions when the assembly is in the stowed configuration.

It will be understood that the scope of the appended claims should not be limited by particular embodiments set forth herein, but should be construed in a manner consistent with the specification as a whole.

What is claimed is:

1. A thruster assembly for a vessel, comprising:

a thruster that generates a flow of water generally along an axis of said thruster;

a passage into said vessel, said passage having an opening generally at an exterior of said vessel and leading to an interior compartment of said vessel; and a drive mechanism coupled to said thruster and configured to pivot said thruster between (i) a first position in which said axis of said thruster is directed such that said flow of water provides propulsion to said vessel, and (ii) a second position in which said axis of said thruster is directed into said opening of said passage such that said flow of water is supplied to or withdrawn from said interior compartment of said vessel;

said interior compartment of said vessel being an interior compartment that ballasts said vessel in response to said flow of water being supplied to said interior compartment through said passage and deballasts said vessel in response to said flow of water being withdrawn from said interior compartment through said passage.

2. The thruster assembly of claim 1, wherein said passage into said vessel comprises:

a chamber having said opening of said passage formed therein.

3. The thruster assembly of claim 2, wherein said passage further comprises:

at least one conduit extending from said chamber to said interior compartment of said vessel.

4. The thruster assembly of claim 3, wherein said at least one conduit further comprises:

an input conduit through which water is supplied from said opening to said interior compartment of said vessel in response to operation of said thruster in a first direction.

5. The thruster assembly of claim 3, wherein said at least one conduit further comprises:

an outlet conduit through which water is withdrawn to said opening from said location onboard said vessel into said chamber in response to operation of said thruster in a second direction.

6. The thruster assembly of claim 3, wherein said at least one conduit further comprises:

a first, inlet conduit in fluid communication with said chamber; and a second, outlet conduit in a fluid communication with said chamber.

7. The thruster assembly of claim 3, wherein said at least one conduit further comprises:

at least one check valve that prevent backflow of water through said conduit.

8. The thruster assembly of claim 3, wherein said opening of said conduit comprises:

an opening located generally at a side of said vessel, with said chamber extending into an interior generally inwardly from said side of said vessel.

9. The thruster assembly of claim 8, wherein said side of said vessel at which said opening is located is a bottom side of said vessel.

10. The thruster assembly of claim 3, wherein said drive mechanism is configured to pivot said thruster between (i) a first position in which said the axis of said thruster extends generally parallel to an axis of said vessel so as to provide propulsion to said vessel; and (ii) a second position in which said axis of said thruster extends generally perpendicular to said axis of said vessel so as to be directed into said opening of said chamber.

11. The thruster assembly of claim 10, wherein said drive mechanism is configured to pivot said thruster between said first and second positions and (iii) a third position in which the thruster is stowed in an interior of said chamber in a position inverted from said first position in which said thruster provides propulsion to said vessel.

12. The thruster assembly of claim 11, wherein said drive mechanism comprises:

at least one pivot connection located proximate the external opening, about which said thruster is pivoted between said positions.

13. The thruster assembly of claim 12, further comprising:

a closure plate mounted to said thruster that closes off said chamber at said exterior of said vessel in response to said thruster being pivoted to (i) said first position in which said thruster provides propulsion to said vessel, and (iii) said third position in which in which thruster is stowed in an interior of said chamber in a position inverted from said first position.

14. The thruster assembly of claim 13, wherein said closure plate comprises:

an outer edge that conforms closely to an edge of said opening at said exterior of said vessel when said thruster is in (i) said first position in which said thruster provides propulsion to said vessel.

15. The thruster assembly of claim 10, wherein said drive mechanism comprises:

a pinion gear that is mounted to said thruster;

a drive gear in engagement with said pinion gear; and an actuator mechanism that rotates said drive gear in a first direction so that said pinion gear rotates in an opposite direction so as to pivot said thruster.

16. The thruster assembly of claim 15, wherein said drive gear comprises:

a quadrant gear.

17. The thruster assembly of claim 15, wherein said actuator mechanism that rotates said drive gear comprises:

a linear actuator; and a linkage connecting an end of said linear actuator to said drive gear at a location spaced from an axis of said drive gear.

18. The thruster assembly of claim 17, wherein said linear actuator comprises:

a hydraulic cylinder.

19. The thruster assembly of claim 17, wherein said linkage comprises:

a link rod having a first end mounted to a first end of said linear actuator and a second end mounted to said drive gear.

20. The thruster assembly of claim 19, wherein said linkage further comprises:

a swing arm connecting a second end of said linear actuator to the chamber via a swing arm that enables the linear actuator to pivot as said linear actuator is extended and retracted.

21. The thruster assembly of claim 20, wherein said swing arm comprises:

a first end that is pivotably mounted to the second end of said linear actuator; and a second end that is pivotably mounted to said chamber.

22. The thruster assembly of claim 21, wherein said second end of said swing arm is pivotably connected to said chamber at said pivot of said drive gear.

23. The thruster assembly of claim 2, further comprising:

a base supporting said drive mechanism, chamber and thruster that is mountable in a cooperating opening in said vessel.

24. A thruster assembly for a vessel, comprising:

a thruster that generates a flow of water generally along an axis of said thruster;

a passage into said vessel, said passage having an opening generally at an exterior of said vessel and leading to a location onboard said vessel, said passage into said vessel comprising:

a chamber having said opening of said passage formed therein;

at least one conduit extending from said chamber to an interior volume on board said vessel, said at least one conduit comprising:

at least one check valve that prevents backflow of water through said conduit; and a drive mechanism coupled to said thruster and configured to pivot said thruster between (i) a first position in which said axis of said thruster is directed such that said flow of water provides propulsion to said vessel, and (ii) a second position in which said axis of said thruster is directed into said opening of said passage such that said flow of water is supplied to or withdrawn from said location onboard said vessel.

25. A thruster assembly for a vessel, comprising:

a thruster that generates a flow of water generally along an axis of said thruster;

a passage into said vessel, said passage having an opening generally at an exterior of said vessel and leading to a location onboard said vessel; and a drive mechanism coupled to said thruster and configured to pivot said thruster between (i) a first position in which said axis of said thruster is directed such that said flow of water provides propulsion to said vessel, (ii) a second position in which said axis of said thruster is directed into said opening of said passage such that said flow of water is supplied to or withdrawn from said location onboard said vessel, and (iii) a third position in which the thruster is stowed in an interior of said chamber in a position inverted from said first position in which said thruster provides propulsion to said vessel.

26. The thruster assembly of claim 25, wherein said drive mechanism comprises:

at least one pivot connection located proximate the external opening, about which said thruster is pivoted between said positions.

27. The thruster assembly of claim 26, further comprising:

a closure plate mounted to said thruster that closes off said chamber at said exterior of said vessel in response to said thruster being pivoted to (i) said first position in which said thruster provides propulsion to said vessel, and (iii) said third position in which in which thruster is stowed in an interior of said chamber in a position inverted from said first position.

28. The thruster assembly of claim 27, wherein said closure plate comprises:

an outer edge that conforms closely to an edge of said opening at said exterior of said vessel when said thruster is in (i) said first position in which said thruster provides propulsion to said vessel.

29. A thruster assembly for a vessel, comprising:

a thruster that generates a flow of water generally along an axis of said thruster;

a passage into said vessel, said passage having an opening generally at an exterior of said vessel and leading to a location discharge onboard said vessel, said passage into said vessel comprising:

a chamber having said opening of said passage formed therein;

at least one conduit extending from said chamber to an interior volume on board said vessel; and a drive mechanism coupled to said thruster and configured to pivot said thruster between (i) a first position in which said axis of said thruster is directed such that said flow of water provides propulsion to said vessel, and (ii) a second position in which said axis of said thruster is directed into said opening of said passage such that said flow of water is supplied to or withdrawn from said location onboard said vessel, said drive mechanism that pivots aid thruster, comprising:

a drive mechanism that pivots said thruster between (i) a first position in which said the axis of said thruster extends generally parallel to an axis of said vessel so as to provide propulsion to said vessel; and (ii) a second position in which said axis of said thruster extends generally perpendicular to said axis of said vessel so as to be directed into said opening of said chamber; said drive mechanism that pivots said thruster between said positions comprising:

a pinion gear that is mounted to said thruster;

a drive gear in engagement with said pinion gear; and an actuator mechanism that rotates said drive gear in a first direction so that said pinion gear rotates in an opposite direction so as to pivot said thruster, said actuator mechanism that rotates said drive gear comprising:

a linear actuator; and a linkage connecting an end of said linear actuator to said drive gear at a location spaced from an axis of said drive gear.

30. The thruster assembly of claim 1, wherein said interior compartment is operative to submerge said vessel in response to being flooded by said flow of water being supplied thereto and to surface said vessel in response to being dewatered by said flow of water being withdrawn therefrom.

* * * * *